US007320511B2

(12) United States Patent
Jung

(10) Patent No.: US 7,320,511 B2
(45) Date of Patent: Jan. 22, 2008

(54) IMAGE FORMING APPARATUS AND HIGH-RESOLUTION PRINTING METHOD IN A HORIZONTAL DIRECTION

(75) Inventor: Young-do Jung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 395 days.

(21) Appl. No.: 10/962,496

(22) Filed: Oct. 13, 2004

(65) Prior Publication Data

US 2005/0134626 A1 Jun. 23, 2005

(30) Foreign Application Priority Data

Dec. 17, 2003 (KR) ..... 10-2003-0092469

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,109,721 A * 8/2000 Kim ..... 347/19
6,398,333 B1 * 6/2002 Mulay et al. ..... 347/14
2003/0043249 A1 * 3/2003 Mihara ..... 347/104
2004/0109035 A1 * 6/2004 Otokita et al. ..... 347/5

FOREIGN PATENT DOCUMENTS

| | | |
|---|---|---|
| JP | 09-57954 | 3/1997 |
| JP | 10-095134 | 4/1998 |
| JP | 12-033739 | 2/2000 |
| JP | 13-146054 | 5/2001 |
| JP | 15-072151 | 3/2003 |

* cited by examiner

*Primary Examiner*—Manish S. Shah
*Assistant Examiner*—Laura E. Martin
(74) *Attorney, Agent, or Firm*—Roylance, Abrams, Berdo & Goodman, L.L.P.

(57) ABSTRACT

An image forming apparatus and a high-resolution printing method for the image forming apparatus are disclosed. The high-resolution printing method includes the steps of receiving from a host computer a print data, calculating a divider coefficient N, a print fire position unit (PFPU), a position offset (PO) and a print position (PP), and a print fire start position (PFSP) based on the print data, detecting a position of the carriage operated by a control signal for driving the carriage, and if the carriage reaches the PP, delaying generation of an ink firing signal, and then starting a printing by generating and outputting the ink firing signal, starting from the PFSP. A high-resolution printing in the horizontal direction can be implemented by properly controlling the PP according to a desired resolution.

11 Claims, 3 Drawing Sheets

IMAGE FORMING APPARATUS AND HIGH-RESOLUTION PRINTING METHOD IN A HORIZONTAL DIRECTION

CROSS-REFERENCE TO RELATED APPLICATIONS

This application claims the benefit under 35 U.S.C. § 119(a) of Korean Application No. 2003-92469, filed Dec. 17, 2003, in the Korean Intellectual Property Office, the entire contents of which are incorporated herein by reference.

BACKGROUND OF THE INVENTION

1. Field of the Invention

The present invention relates to an image forming apparatus and a high-resolution printing method in a horizontal direction using the same. More particularly, the present invention relates to an image forming apparatus and a high-resolution printing method in a horizontal direction using the same, which can perform a high-resolution printing in a horizontal direction by delaying the generation of an ink firing signal.

2. Description of the Related Art

Image forming apparatuses print images corresponding to input original image data onto a recording medium such as paper. The image forming apparatuses may be printers, copiers, or facsimile machines. The printer is one of many peripheral devices of a computer, and particularly an output device that prints the contents produced according to a user's computer work onto the paper.

Printers may be classified into dot matrix printers, inkjet printers, and laser printers, according to their printing types. Since inkjet printers have a good printing quality at a low price and with low noise, they have widely been used for performing office work and computer output work. Recently, user demand for high-resolution prints using the inkjet printer has been increasing.

In the inkjet printer, two factors determine resolution in a horizontal direction. The factors are resolution of an inkjet head and a mechanical/electrical characteristics of a carriage system. The inkjet head forms an image by firing ink, and the carriage system mounts the inkjet head and reciprocates in a horizontal direction.

The resolution in the horizontal direction is determined through a photo encoder sensor and a strip encoder for detecting actual position information of the carriage system.

A conventional method restrictively implements high-resolution printing in the horizontal direction by using a dummy slice or a compulsory fire delay. This method, however, is not satisfactory for implementing high resolution.

Meanwhile, another conventional method for achieving high resolution in the horizontal direction is to physically heighten the mechanical/electrical characteristics of the carriage system. Still another conventional method is to increase the resolution of an encoder system. However, these methods have the problem of requiring additional expense.

SUMMARY OF THE INVENTION

An aspect of the present invention is to solve at least the above problems and to provide at least the advantages described below. Accordingly, an aspect of the present invention is to provide an image forming apparatus and a high-resolution printing method for the image forming apparatus which can implement high-resolution printing in a horizontal direction by obtaining a print fire position unit, a position offset, a print position and a print fire start position using given print position information and print speed information and by properly controlling the print position according to a desired resolution.

In order to achieve the above-described aspects of the present invention, there is provided a high-resolution printing method in a horizontal direction for an image forming apparatus. The method comprising the steps of receiving from a host computer a print data, calculating a divider coefficient N, a print fire position unit (PFPU), a position offset (PO) and a print position (PP), and a print fire start position (PFSP) based on the print data, sensing a position of the carriage operated by control signal for driving the carriage, and delaying generation of an ink firing signal if the carriage reaches the PP, and then initiating printing by generating and outputting the ink firing signal, starting from the PFSP.

It is preferable that the divider coefficient is a value obtained by dividing the desired resolution value by a currently used actual resolution value.

It is also preferable that the PO is the remainder obtained by dividing the print position information by the divider coefficient.

It is also preferable that the PFPU is calculated by the following equation $$(CF \div PS) \div N$$

wherein, CF denotes a conversion factor, PS denotes a print speed, and N denotes a divider coefficient.

It is also preferable that if n is a natural number, the print position is a value that is obtained by dividing a value, which is obtained by multiplying the quotient of the print position information divided by the divider coefficient that is the divisor by the divider coefficient, by the desired resolution, and then by abbreviating the obtained value by the divider coefficient to express the obtained value in the unit of an n/600 inch.

Preferably, the position of the carriage is detected through a sensor part attached to one surface of the carriage.

Preferably, the sensor part comprises a dual sensor, and detects the position of the carriage using 2-channel sensing signals CH1 and CH2.

Preferably, the 2-channel sensing signals have a distance of a 1/150 inch for a period, and have a phase difference of 90°.

Another aspect of the present invention is to provide an image forming apparatus comprising a printer interface for providing a communication interface with a host computer, a sensor part for sensing a position of a carriage, and then outputting a position information signal of the carriage, and a control part for calculating a divider coefficient N, a print fire position unit (PFPU), a position offset (PO), a print position (PP), and a print fire start position (PFSP) based on a print data provided from the host computer, if the carriage reaches the PP, delaying generation of an ink firing signal, and then generating and outputting the ink firing signal, starting from the PFSP.

It is preferable that the print data includes print position information, print speed information and a desired resolution value.

It is also preferable that the image forming apparatus further comprises a storage part for storing the print position PP and the PFSP.

Preferably, the storage part comprises a register.

BRIEF DESCRIPTION OF THE DRAWINGS

The above aspects and features of the present invention will be more apparent by describing certain embodiments of the present invention with reference to the accompanying drawings, in which.

Throughout the drawings, it should be noted that the same or similar elements are denoted by like reference numerals.

DETAILED DESCRIPTION OF THE PREFERRED EMBODIMENTS

Certain embodiments of the present invention will be described in greater detail with reference to the accompanying drawings.

Figure 1:
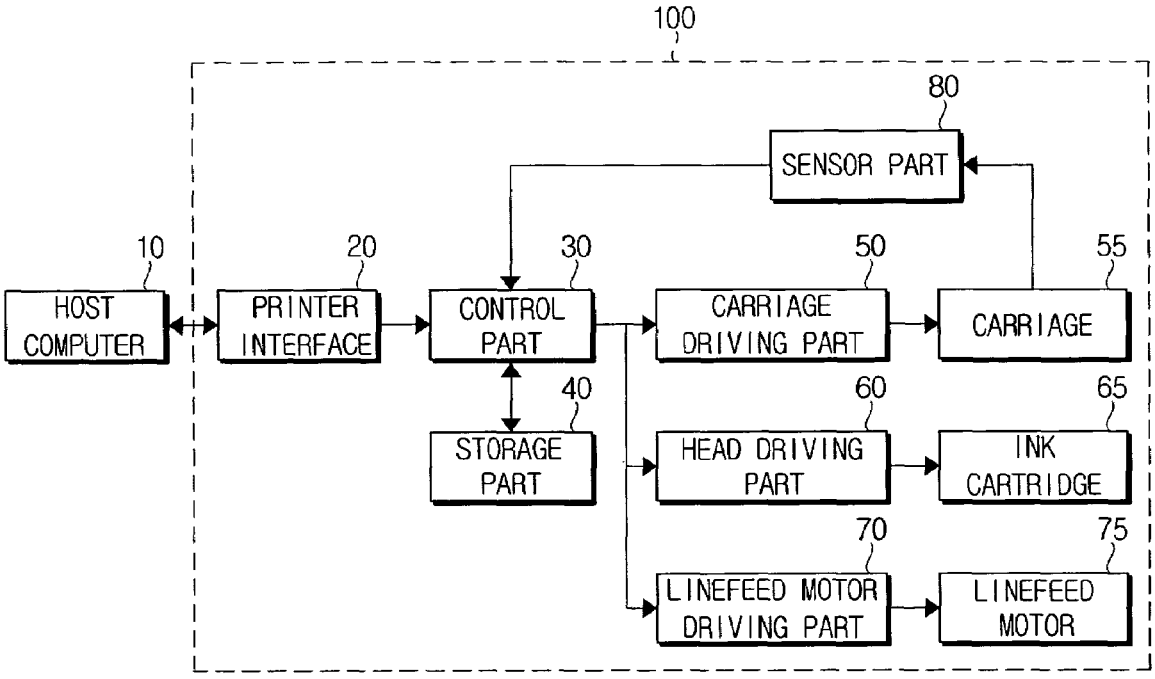
FIG. 1 is a block diagram illustrating the internal construction of an image forming apparatus according to an embodiment of the present invention.

FIG. 1 is a block diagram illustrating the internal construction of an image forming apparatus, particularly an inkjet printer, according to an embodiment of the present invention.

Referring to FIG. 1, the inkjet printer 100 includes a printer interface 20, a control part 30, a storage part 40, a carriage driving part 50, a carriage 55, a head driving part 60, an ink cartridge 65, a linefeed motor driving part 70, a linefeed motor 75, and a sensor part 80.

In order to achieve high-resolution printing in a horizontal direction, print data which includes information such as print position information, print speed information and a desired resolution value is provided from a host computer 10 to the control part 30 through the printer interface 20.

The control part 30 calculates a divider coefficient N, a print fire position unit (PFPU), a position offset (PO) and a print position (PP) based on the print data provided from the host computer 10, and then calculates a print fire start position (PFSP) based on the calculated PFPU and the PO.

The storage part 40 stores the PP and the PFSP calculated by the control part 30. It is preferable that the storage part is implemented through a register.

Also, the control part 30 generates a control signal for driving the carriage 55, and sends the control signal to the carriage driving part 50. The carriage driving part 50 receives the carriage driving signal, and sends a carriage operating signal to a carriage motor (not illustrated). As the carriage motor operates, the carriage starts to move in the horizontal direction. The carriage driving part 50 may be implemented through a DC motor or a step motor.

The sensor part 80 is attached to one surface of the carriage 55, and detects the position of the carriage 55. The sensor part 80 can be implemented through a dual sensor, which generates 2-channel sensing signals. The position information signal of the carriage 55 detected by the 2-channel sensing signals is fed back to the control part 30.

The control part 30 confirms whether the carriage 55 reaches the PP.

The head driving part 60 starts the driving of the ink cartridge 65 in response to the predetermined control signal from the control part 30. The ink cartridge 65 forms dots by firing fine ink drops from a nozzle having a plurality of openings.

The linefeed motor driving part 70 receives a linefeed motor driving signal from the control part 30, and drives the linefeed motor 75. The linefeed motor 75, which may be a step motor, serves to deliver printing papers.

Hereinafter, the operation of the image forming apparatus as constructed above according to an embodiment of the present invention will be explained in detail.

Figure 2:
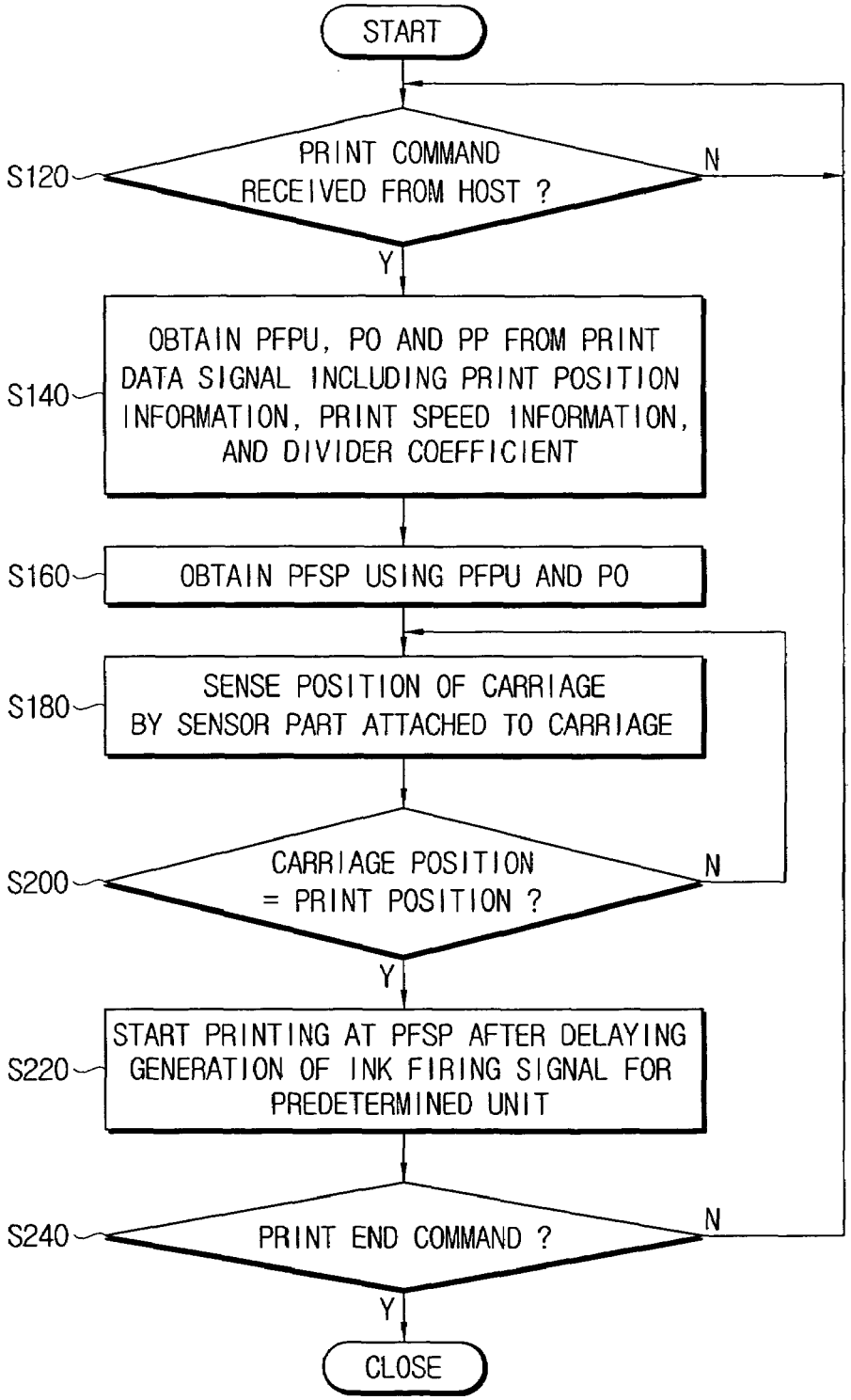
FIG. 2 is a flowchart illustrating a high-resolution printing method in a horizontal direction according to an embodiment of the present invention.
Figure 3:
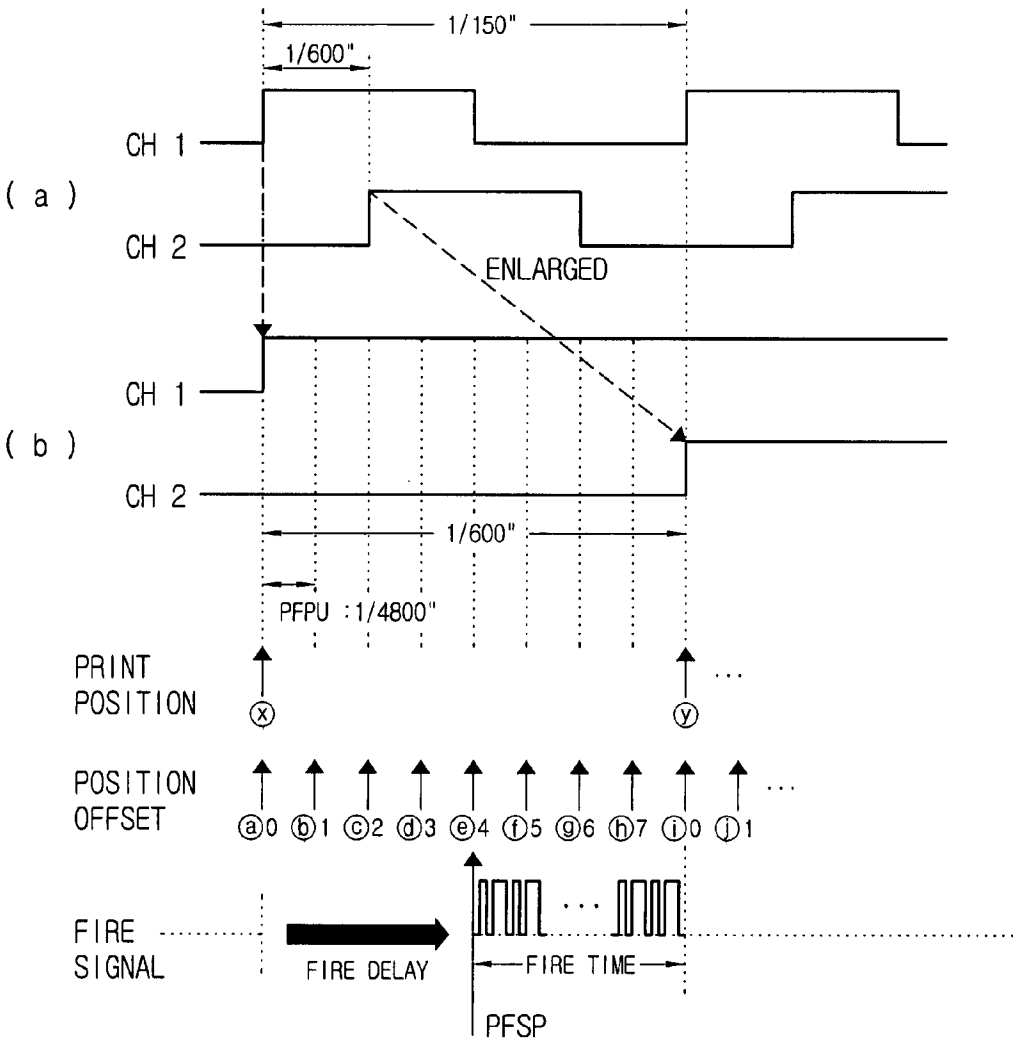
FIG. 3 is a diagram illustrating an example of implementing a resolution of 4800 dpi according to an embodiment of the present invention.

FIG. 2 is a flowchart illustrating a high-resolution printing method in a horizontal direction according to an embodiment of the present invention, and FIG. 3 is a view explaining an example of implementing a resolution of 4800 dpi according to an embodiment of the present invention.

Referring to FIG. 2, if a print command is input from the host computer 10 according to a user's request at step S120, the print data is transmitted from the host computer 10 to the control part 30 through the printer interface 20. The print data includes the print position information data, the print speed information data, and the desired resolution.

The print speed is changed according to a print mode set by a user. The print mode comprises a high-speed mode and a normal mode.

The print position information is provided by the host computer 10 in order to achieve high-speed printing in the horizontal direction.

The desired resolution given by the host computer 10 is more than 600 dpi, which is an actual resolution value that can currently be implemented in the inkjet printer. In the inkjet printer having an actual resolution of 600 dpi, an ink firing signal is discharged for every $1/600$ inch. Hereinafter, for convenience of explanation, $1/600$ inch, the distance for which the ink firing signal is discharged is called an absolute distance. If the desired resolution is 4800 dpi and a given print position information is 100, the printing starts at a distance of $100/4800$ inch.

The control part 30 calculates the PFPU, the PO, and the PP as shown in FIG. 2 from the print position information data and the print speed information data at step S140.

The PO is the remainder value obtained by dividing the print position information by a divider coefficient N.

The divider coefficient N is obtained by the following equation.

$$N=DHR/RR \qquad \text{Equation 1}$$

In the equation, DHR denotes the desired resolution value, and RR denotes an actual resolution value of the currently used inkjet printer.

If the desired resolution is 4800 dpi and the actual resolution of the inkjet printer is 600 dpi, the divider coefficient N becomes 8 by calculating 4800 dpi/600 dpi.

If the print position information for achieving high-resolution given by the host computer 10 is 100 and the desired resolution is 4800 dpi, the print start position commanded by the host for the high-resolution printing is $100/4800$ inch.

The PO is the remainder value obtained by dividing the print position information, e.g., 100, by the divider coefficient N. If the desired resolution is 4800 dpi, the divider coefficient N is 8 by calculating 4800 dpi/600 dpi, and in this case, the PO becomes 4 which is the remainder obtained by dividing the PP, e.g., 100, by the divider coefficient, e.g., 8.

The PP is obtained based on the given print position information, the divider coefficient N and the desired resolution value.

The PP is a value that is obtained by dividing a value, which is obtained by multiplying the quotient of the print position information divided by the divider coefficient N that is the divisor by the divider coefficient N, by the desired resolution, and then by abbreviating the obtained value by the divider coefficient N to express the obtained value in the unit of an n/600 inch. Here, n is a natural number.

In the above-described example, the quotient of the print position information, e.g., 100, commanded from the host for the high-resolution printing, divided by the divider coefficient N, e.g., 8, is 12. Then, by dividing 96, which is obtained by multiplying the quotient, e.g., 12, by the divisor, e.g., 8, by the desired resolution value, $^{96}/_{4800}$ is obtained. Then, by abbreviating this value by the divider coefficient N, e.g., 8, $^{12}/_{600}$ inch is obtained as the PP.

The print fire position unit PFPU is obtained by the following equation.

$$PFPU=(CF\div PS)\div N \qquad \text{Equation 2}$$

Here, PFPU denotes a print fire position unit, CF denotes a conversion factor, PS denotes a print speed commanded by a host, and N denotes a divider coefficient. The conversion factor is a value set when a carriage system of an inkjet printer is designed in order to preferably control the carriage system, and is obtained by a reference clock having a predetermined period for the absolute distance, e.g., $^{1}/_{600}$ inch. In an embodiment of the present invention, the period of the reference clock is 0.12 μsec.

If the print speed commanded from the host is 20 ips, the PFPU is obtained by dividing the conversion factor obtained as the above by a corresponding speed, e.g., 20, and then dividing the obtained value by the divider coefficient.

The control part 30 obtains the PFSP as illustrated in FIG. 2 based on the obtained PFPU and the PO at step S160.

The PFSP is the print start position for implementing a high-resolution printing after the firing signal is delayed from the PP obtained as the above.

The PFSP is obtained by the following equation.

$$PFSP=PO\times PFPU \qquad \text{Equation 3}$$

Here, PFSP denotes a print fire start position, PO denotes a position offset, and PFPU denotes a print fire position unit.

Through the above process, the PP and the PFSP calculated by the control part 30 are stored in the storage part 40. The storage part 40 can be implemented through a register.

The control part 30 sends the control signal for driving the carriage 55 to the carriage driving part 50. Accordingly, the carriage motor operates to make the carriage 55 move in the horizontal direction.

If the carriage 55 operates, the sensor part 80 attached to one surface of the carriage 55 detects the position of the carriage 55 by generating the 2-channel sensing signals CH1 and CH2 as illustrated in FIG. 3, and sends the detected position of the carriage to the control part 30 at step S180.

Referring to (a) in FIG. 3, the 2-channel sensing signals CH1 and CH2 generated from the sensor part 80 are clock signals having a period of $^{1}/_{150}$ inch, and are changed from a high level to a low level for every $^{1}/_{300}$ inch.

The second sensing signal CH2 has a phase difference of 90° from the first sensing signal CH1.

In the currently-used inkjet printer, as illustrated as (b) in FIG. 3, the ink firing signal is generated for every $^{1}/_{600}$ inch during the printing operation of the printer. In FIG. 3, points ⓧ and ⓨ indicate an n/600 inch point and an (n+1)/600 point, respectively, where the ink firing signal is discharged. Here, n is a natural number.

The control part 30 confirms whether the carriage 55, which is operated by the carriage driving signal, reaches the PP at step S200.

If the carriage reaches the PP, the control part 80 delays the generation of the ink firing signal, and then generates and outputs the ink firing signal at the PFSP to start printing at step S220.

For example, if the PO is '0' in FIG. 3, the ink firing signal is discharged at the point ⓧ to start the printing, and if the PO is 4, the ink firing signal is discharged at a distance where the PFPU is delayed for 4 to start printing.

As described above, if the carriage reaches the PP, the head driving part 60 is controlled to delay generation of the ink firing signal, and generates and outputs the ink firing signal at the PFSP.

At the time point of discharging the ink firing signal, fine ink drops from the ink cartridge 65 are fired through a nozzle having a plurality of openings. Specifically, if the PP is $^{100}/_{4800}$ inch, the inkjet printer having a resolution of 600 dpi performs a high-resolution printing in the horizontal direction by delaying the ink firing signal for a $^{4}/_{4800}$ inch.

The firing time of the ink fired by the ink cartridge 65 may be set less than the time required for one period distance (e.g., $^{1}/_{600}$ inch) of the 2-channel sensing signals generated by the sensor part 80.

Through the above-described process, the high-resolution printing in the horizontal direction is performed. If a print end command is input from the host computer, the printing is terminated at step S240.

As described above, embodiments of the present invention provide the advantages of the high-resolution printing in the horizontal direction by obtaining the PFPU and the PO using the given print position information and the print speed information and by properly controlling the PP according to the desired resolution, and thus it can effectively be applied to image alignments for a bi-directional printing.

Also, according to embodiments of the present invention, a separate device is not required to implement the high-resolution printing in the horizontal direction, and thus no additional expense is required to heighten the resolution.

Also, according to embodiments of the present invention, the resolution in the horizontal direction can be increased up to a threshold value that is restricted by the carriage system, and inkjet head. For example, if the divider coefficient N is 8, a resolution of 4800 dpi can be obtained.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A high-resolution printing method for printing in a horizontal direction for an image forming apparatus, comprising the steps of:

receiving from a host computer a print data;

calculating a divider coefficient N, a print fire position unit (PFPU), a position offset (PO) and a print position (PP), and a print fire start position (PFSP) based on print data;

detecting a position of a carriage operated by a control signal for driving the carriage; and if the carriage reaches the PP, delaying generation of an ink firing signal and then starting a printing by generating and outputting the ink firing signal, starting from the PFSP;

wherein the PO is the remainder obtained by dividing print position information by the divider coefficient N.

2. The printing method as claimed in claim 1, wherein the divider coefficient is a value obtained by dividing the desired resolution value by a current actual resolution value.

3. The printing method as claimed in claim 1, wherein the PFPU is calculated by the following equation $$(CF \div PS) \div N$$

wherein CF denotes a conversion factor, PS denotes a print speed, and N denotes a divider coefficient.

4. The printing method as claimed in claim 1, wherein, if n is a natural number, the PP is a value obtained by dividing a value obtained by multiplying the quotient of the print position information divided by the divider coefficient which is the divisor by the divider coefficient, by the desired resolution, and then by abbreviating the obtained value by the divider coefficient to express the obtained value in the unit of an n/600 inch.

5. The printing method as claimed in claim 1, wherein the position of the carriage is detected through a sensor part attached to one surface of the carriage.

6. The printing method as claimed in claim 5, wherein the sensor part comprises a dual sensor, and detects the position of the carriage using 2-channel sensing signals.

7. The printing method as claimed in claim 6, wherein the 2-channel sensing signals have a distance of a 1/150 inch for a period, and have a phase difference of 90°.

8. An image forming apparatus comprising:

a printer interface for providing a communication interface with a host computer;

a sensor part for detecting a position of a carriage, and then outputting a position information signal of the carriage; and a control part for calculating a divider coefficient N, a print fire position unit (PFPU), a position offset (PO), a print position (PP), and a print fire start position (PFSP) based on a print data provided from the host computer, if the carriage reaches the PP, delaying generation of an ink firing signal, and then generating and outputting the ink firing signal, starting from the PFSP;

wherein the PO is the remainder obtained by dividing print position information by the divider coefficient N.

9. The image forming apparatus as claimed in claim 8, wherein the print data includes print position information, print speed information and a desired resolution value.

10. The image forming apparatus as claimed in claim 9, further comprising a storage part for storing the PP and the PFSP.

11. The image forming apparatus as claimed in claim 10, wherein the storage part comprises a register.

* * * * *